US010945569B1

(12) United States Patent
Varghese

(10) Patent No.: US 10,945,569 B1
(45) Date of Patent: Mar. 16, 2021

(54) BODY DRYER SYSTEM AND METHOD OF USE

(71) Applicant: Sibu Varghese, Sugar Land, TX (US)

(72) Inventor: Sibu Varghese, Sugar Land, TX (US)

( * ) Notice: Subject to any disclaimer, the term of this patent is extended or adjusted under 35 U.S.C. 154(b) by 64 days.

(21) Appl. No.: 16/417,825

(22) Filed: May 21, 2019

Related U.S. Application Data

(60) Provisional application No. 62/674,224, filed on May 21, 2018.

(51) Int. Cl.
*A45D 20/18* (2006.01)
*A47K 10/48* (2006.01)
*F24H 3/04* (2006.01)

(52) U.S. Cl.
CPC ..... *A47K 10/48* (2013.01); *F24H 3/0405* (2013.01)

(58) Field of Classification Search
CPC ..... A47K 10/48; F24H 3/0405; F24H 3/04; A45D 20/18
USPC ..... 34/96, 283, 525
See application file for complete search history.

(56) References Cited

U.S. PATENT DOCUMENTS 2,103,577 A * 12/1937 Farrell ..... A45D 42/02 132/316
3,128,161 A * 4/1964 Hudon ..... A47K 10/48 34/233
5,279,048 A * 1/1994 Lawall ..... A45D 20/12 34/90
7,158,716 B2 * 1/2007 Shapiro ..... F04D 17/04 392/365
7,900,371 B1 * 3/2011 Bullard ..... A47K 10/48 34/202
2003/0192194 A1 * 10/2003 Evanyk ..... A45D 20/30 34/96
2005/0086735 A1 * 4/2005 Lim ..... A47K 3/32 4/596
2012/0273606 A1 * 11/2012 Redd ..... A47K 10/3818 242/588.6
2013/0025149 A1 * 1/2013 Farousi ..... A47K 10/48 34/88
2015/0184937 A1 * 7/2015 Hywel ..... F26B 9/066 34/202
2017/0335553 A1 * 11/2017 Martin ..... A45D 20/08
2018/0347103 A1 * 12/2018 Lee ..... D06F 58/10

* cited by examiner

*Primary Examiner* — John P McCormack
(74) *Attorney, Agent, or Firm* — Richard Eldredge; Leavitt Eldredge Law Firm

(57) ABSTRACT

A body dryer system includes a drive unit to heat and pressurize air; a head unit to expel air; a power system and a control system; the power system and the control system are to activate the drive unit; and air is heated and pressurized via the drive unit and pushed to the head unit to be expelled.

6 Claims, 7 Drawing Sheets

BODY DRYER SYSTEM AND METHOD OF USE

BACKGROUND

1. Field of the Invention

The present invention relates generally to body drying systems and apparatuses, and more specifically, to a body dryer system configured to expel warm air to dry a user's body.

2. Description of Related Art

Body dryer systems are well known in the art and are effective means to remove water, such as after a shower. For example, FIG. 1 depicts a conventional drying system 101 having a towel rack 103 with a plurality of towels 105 secured thereon, during use, one of the plurality of towels is removed and used by the user to dry their body.

One of the problems commonly associated with system 101 is efficiency. For example, it is common for the towels to not be fully dry when the user needs them. In addition, the bathroom in which the user showers may be cool and therefore uncomfortable.

Accordingly, although great strides have been made in the area of body drying systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
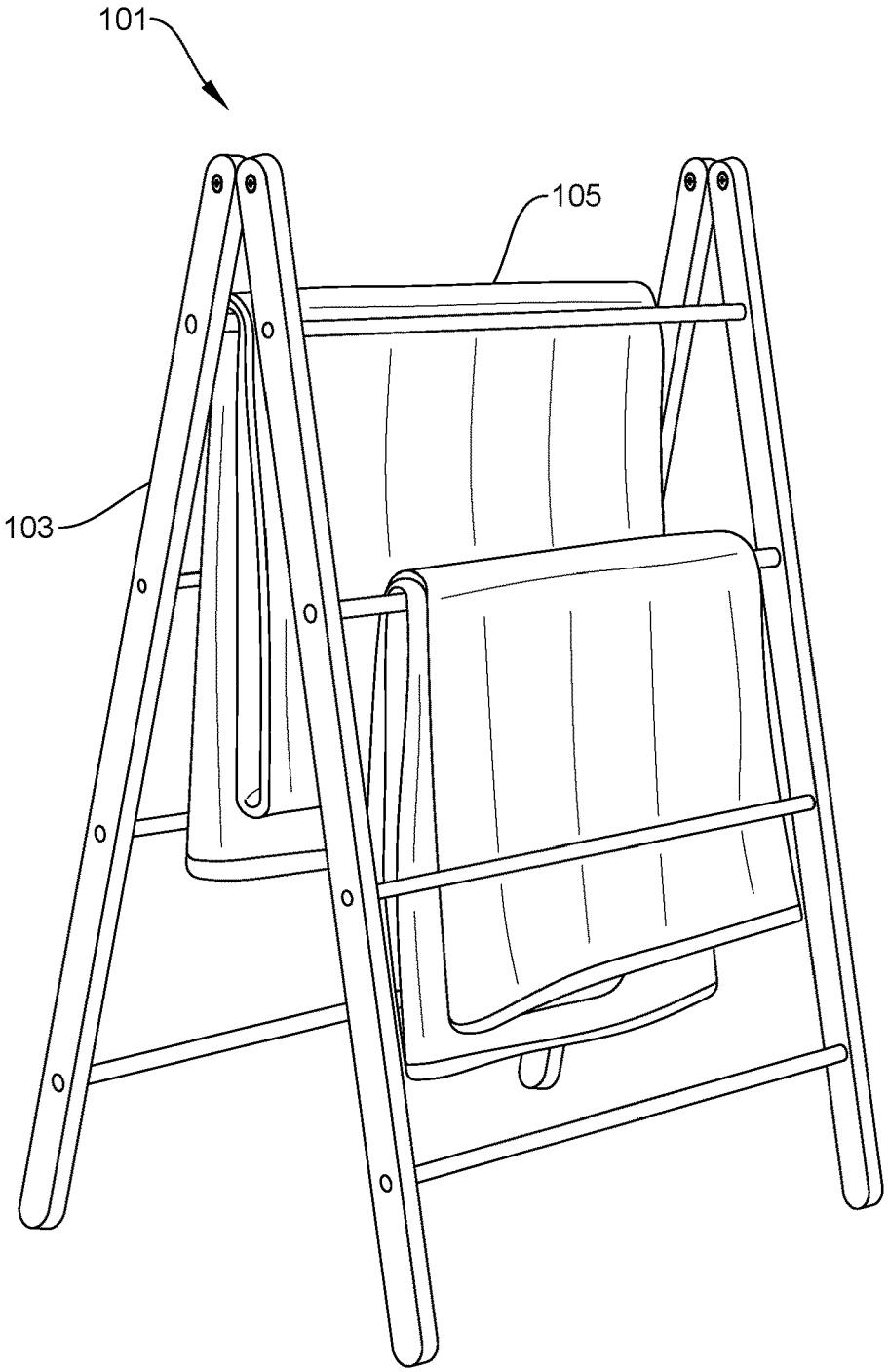
(Prior Art) FIG. 1
FIG. 1 is an oblique view of a common body drying system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional body dryer systems. Specifically, the present invention provides a body dryer system configured to expel warm air onto the user in order to evaporate water, thereby drying the user without the need for a towel and further providing the comfort of warm air. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2A:
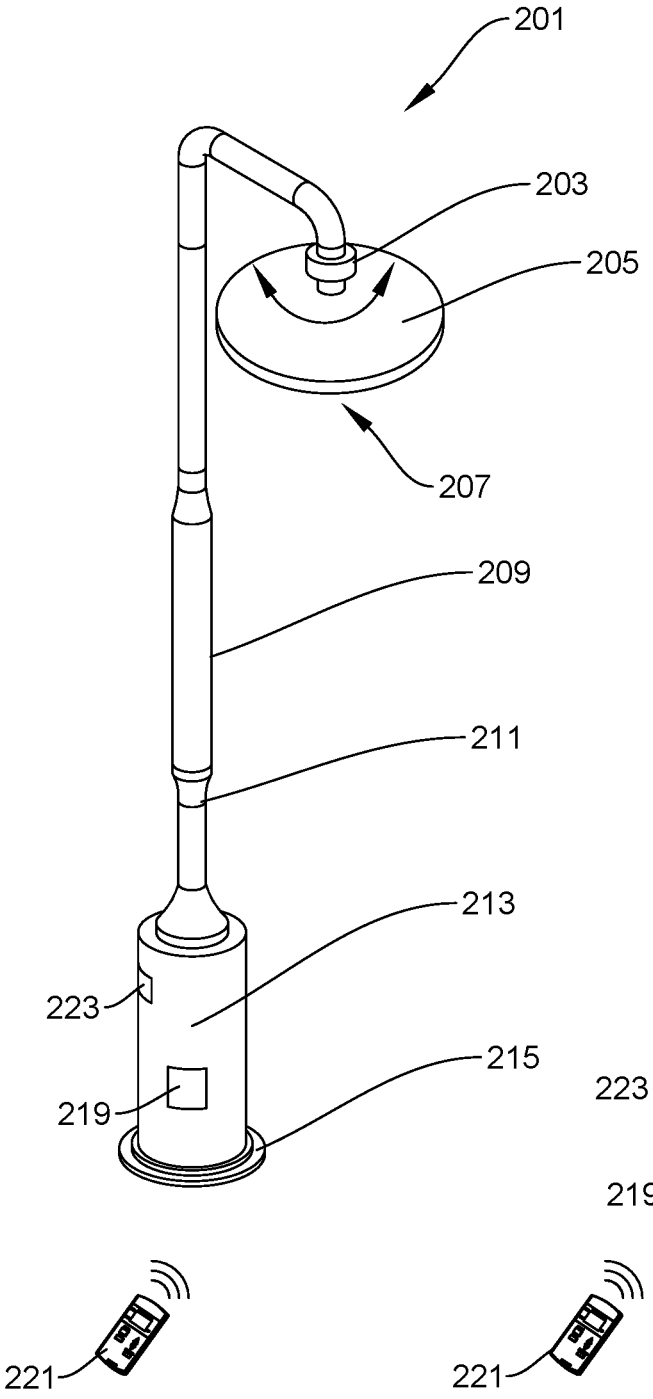
FIGS. 2A and 2B are oblique views of a body dryer system in accordance with a preferred embodiment of the present application.
Figure 2B:
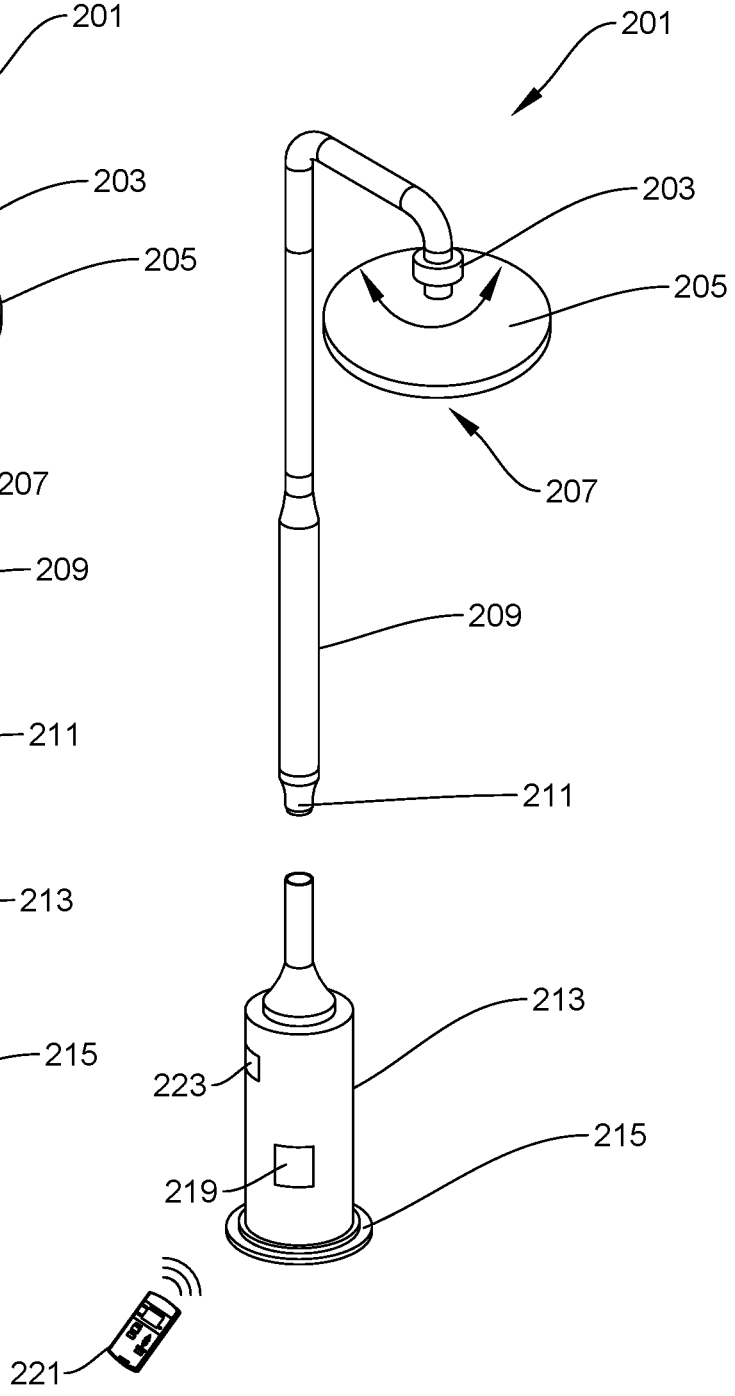

Referring now to the drawings wherein like reference characters identify corresponding or similar elements throughout the several views, FIGS. 2A and 2B depict oblique views of a body dryer system 201 in accordance with a preferred embodiment of the present application. It will be appreciated that system 201 overcomes one or more of the above-listed problems commonly associated with conventional body dryer systems.

In the contemplated embodiment, system 201 includes an elongated and adjustable tower 209 extending from a drive unit 213 to head unit 205. It should be appreciated that in the preferred embodiment, the adjustable tower 209 is a thin, pipe-like, elongated flow conduit, thereby making system 201 compact and easy to move. In addition, the compact nature of system 201 allows for the system to be used in small bathrooms.

In some embodiments, the head 205 is attached via a swivel mechanism 203, thereby allowing for the head to turn and pivot, as shown with the arrow. It should be appreciated that head 205 can further vary in size and shape as desired. In some embodiments, head 205 further includes a sensor 207 configured to sense the presence of a user underneath the sensor. It is contemplated that the sensor 207 could be infrared, motion, or any other means.

System 201 can further include a quick connection 211 and can be configured to allow a top portion of system 201 to disconnect from drive unit 213. This feature would allow for the drive unit to be used independent of the other elements.

System 201 can further include a rechargeable battery unit 215 attached to base 213. Alternatively, system 201 could include cords (not shown) to allow for system 201 to be plugged in.

System 201 can further include a control system 219 configured to operate system 201. Control system 219 can command features such as temperature, power, and activation. In some embodiments, control system 219 can be configured to wirelessly communicate with a remote device 221, such as a remote, or mobile phone. It should further be appreciated, that the control system can include features such as lights, speakers, the ability to play music, times, etc.

In the preferred embodiment, the drive unit comprises at least a turbo axial fan blade, a motor, a heating element, and an electronic control module 219 configured to pull in and pressurize air to be transmitted to the head unit.

It is contemplated that system 201 can include additional features, such as a scent pocket 223 wherein the user can input scents, such as essential oils, that will then be dispersed via head 205. Scent pocket 223 can be accessed via a door or the like secured on the outside of drive unit 213, or any other conventional means. Further, it is contemplated that in some embodiments, the system can function as a room heater, as opposed to a body dryer. In addition, in some embodiments, the drive unit can be used for other applications, such as a leaf blower.

It should be appreciated that one of the unique features believed characteristic of the present application is the compact nature of system 201, thereby allowing for the use of system 201 in compact spaces.

Figure 3:
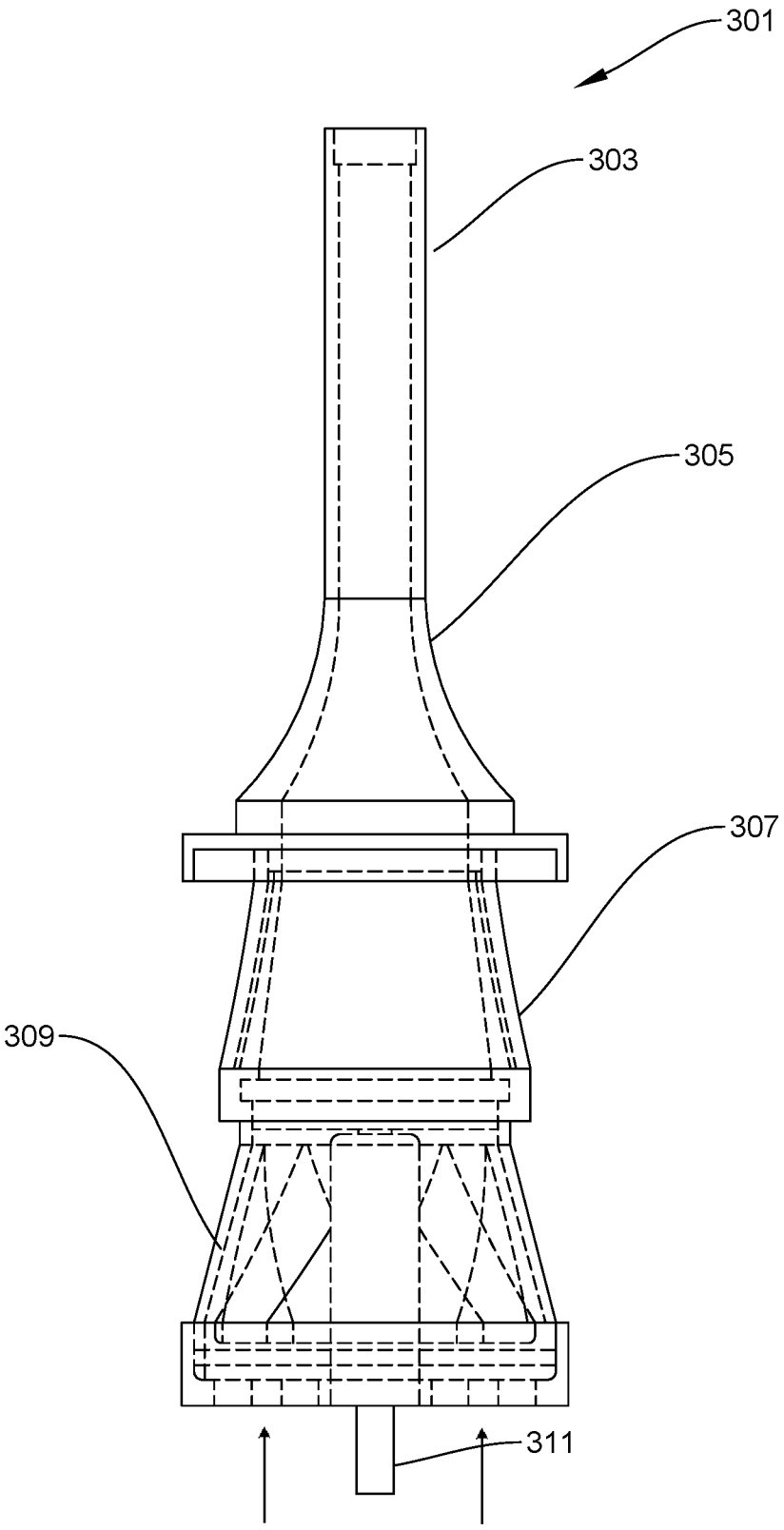
FIG. 3 is a front view of an embodiment of an air turbo axial fan blade unit for use with the body dryer system in accordance with a preferred embodiment of the present application.

In FIG. 3, a front view of a drive unit 301 is shown. In the preferred embodiment, a flow discharge unit 303 having a tapered and converging end 305 (converger) is connected to a heating element 307 assembly. The heating assembly 307 is further connected to a turbo axial fan blade assembly 309. During use, air is pulled into the assembly (as shown with arrows) wherein a fluid driver shaft 311 is in communication with the turbo axial fan blade assembly and the air is compressed/pressurized via the turbo axial fan blade assembly 309. The high pressured/pressurized air is forced into the heating element assembly, wherein the heat further pressurizes the air. The air is then pushed through the converging chamber 305 and into the flow discharge unit, wherein the converging chamber further compresses and pressurizes the air. This system creates highly pressurized air that can travel quickly from the unit 213 and to the head 205 to be exerted onto the user.

Figure 4:
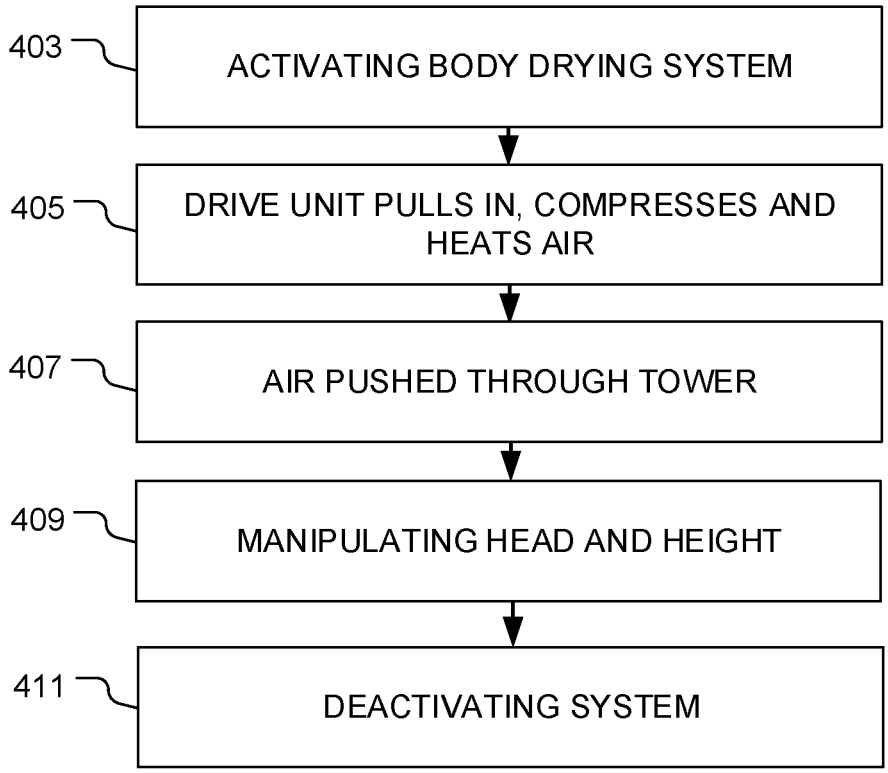
FIG. 4 is a flowchart of the method of use of the body dryer system of FIG. 2.

In FIG. 4, a flowchart 401 depicts the method of use of system 201. During use, system 201 is activated, either via a control directly on driver unit 213, or via a remote device, as shown with box 403. The drive unit begins the process of pressurizing and heating air, as shown with box 405. The warm air is pushed through tower 209 to head 205, wherein the air is exerted onto the user, as shown with box 407. As desired, the user can manipulate the angle of the head and adjust the height of the tower 209, as shown with box 409. Once the user is dry, the user deactivates system 201, as shown with box 411.

Figure 5:
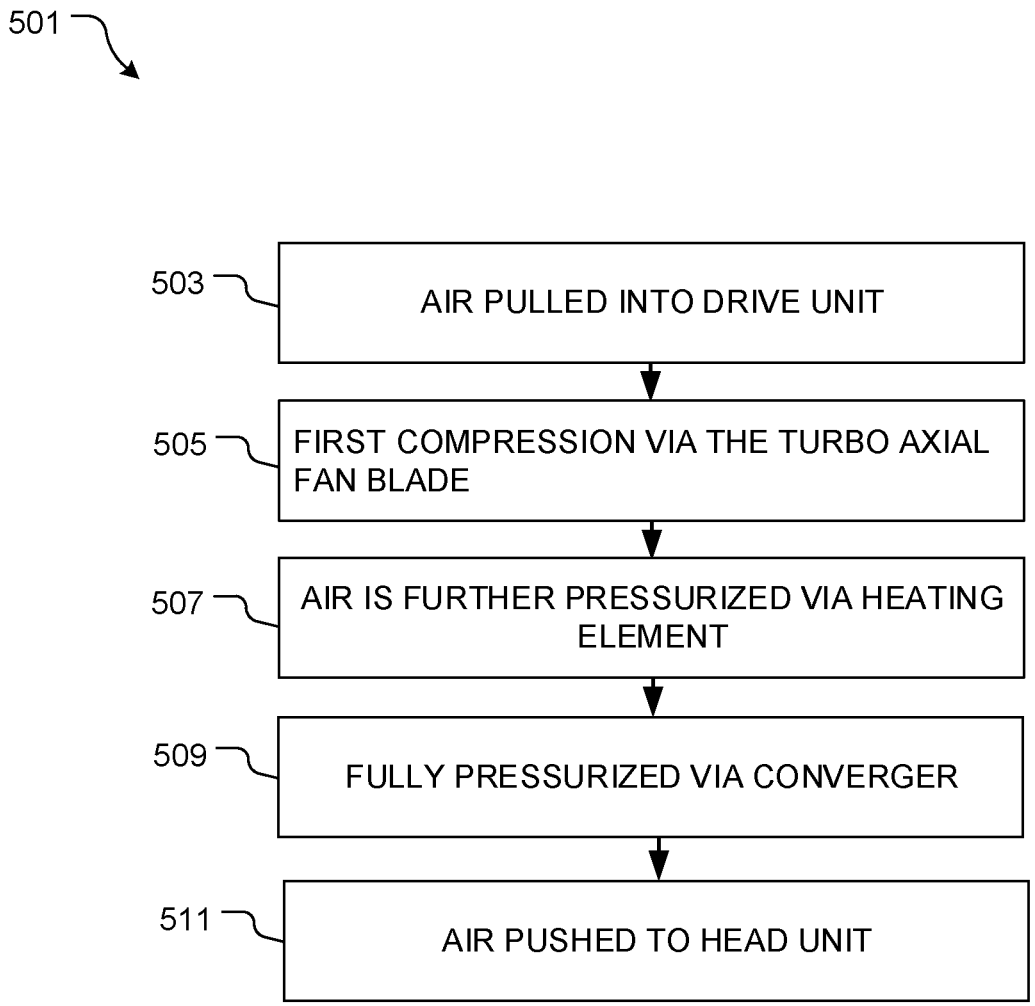
FIG. 5 is a flowchart of the method of use of the air turbo axial fan blade unit of FIG. 3.

In FIG. 5, a flowchart 501 depicts the method of use of drive unit 301. During use, air is pulled into the drive unit, as shown with box 503. The air goes through a first stage of pressurization via turbo axial fan blade 309, as shown with box 505. The air is then pushed into the heating element 307, wherein the heat further pressurizes the air, as shown with box 507. As the air is further pushed into converger 305, the air is fully pressurized with enough force to easily reach and expel from the head unit, thereby providing comfortable heat and force to the user, as shown with boxes 509, 511.

Figure 6:
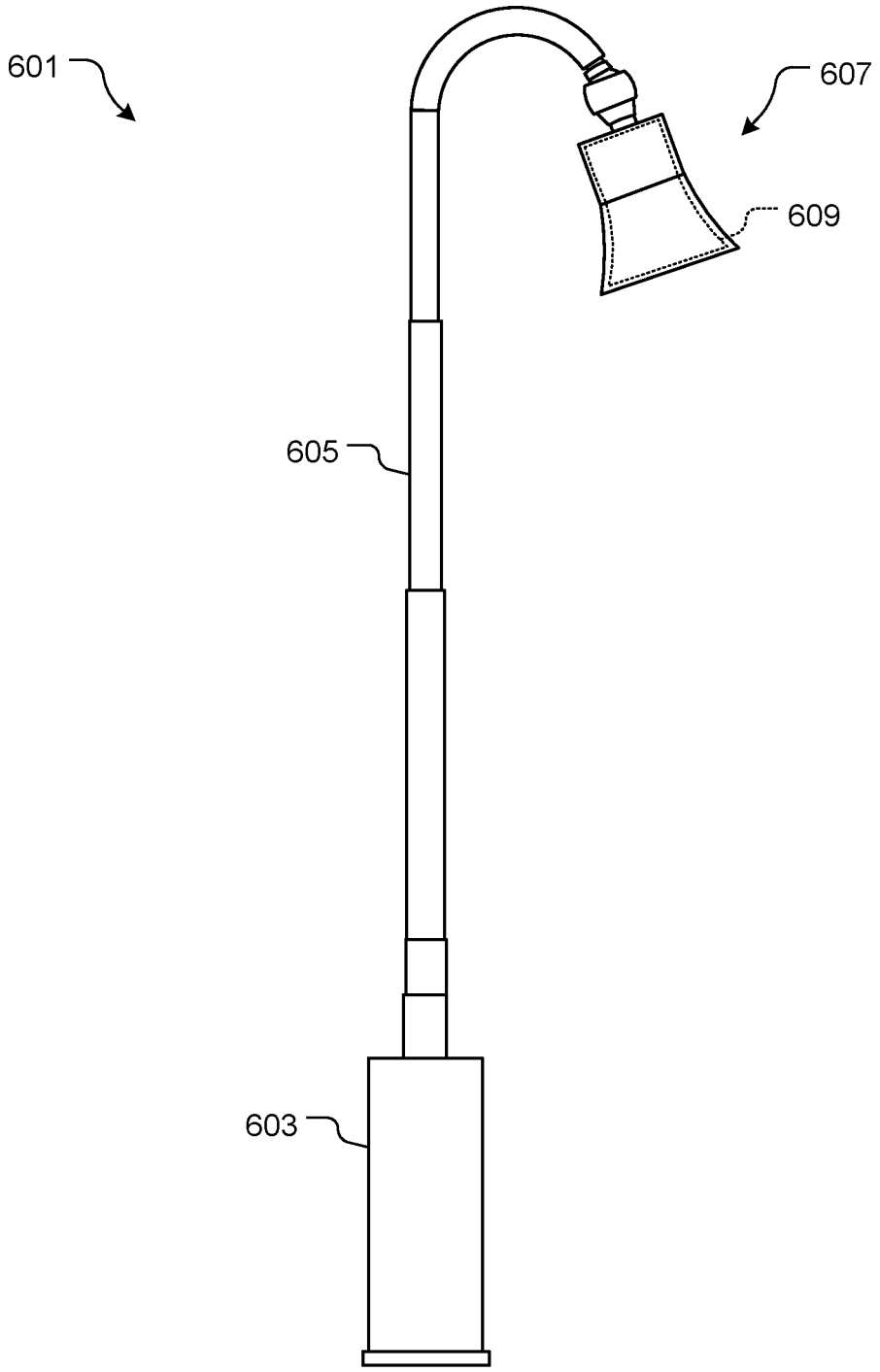
FIG. 6 is a side view of an alternative embodiment of a body dryer system in accordance with the present invention.

In FIG. 6, a side view depicts an alternative embodiment of a body dryer system 601 in accordance with the present invention. System 601 can include any of the features discussed above and includes a base 603 with a tower 605 extending to a head unit 607. In this embodiment, a drive unit 609 is positioned within an interior of the head unit, the drive unit 609 being the same as previously discussed.

Figure 7:
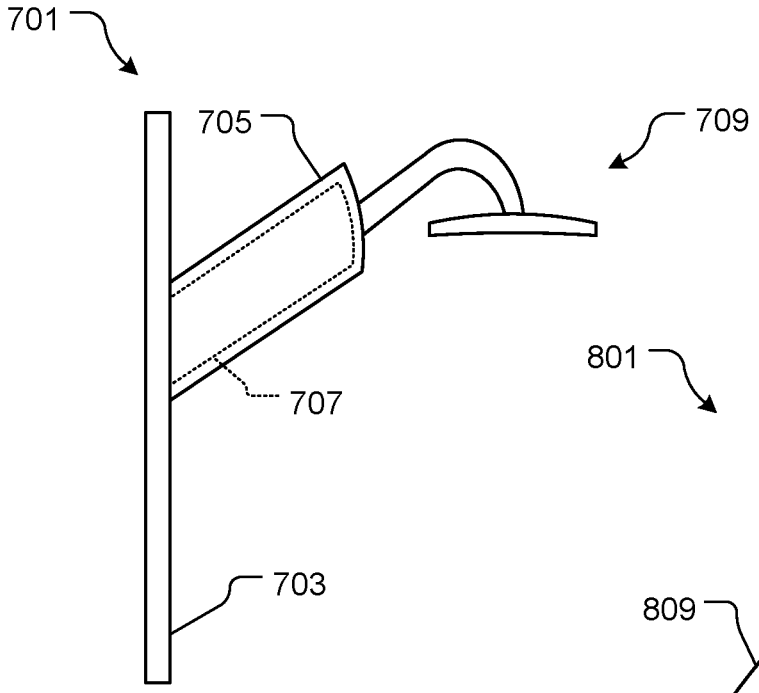
FIG. 7 is a side view of an alternative embodiment of a body dryer system in accordance with the present invention.

In FIG. 7, yet another alternative embodiment of a body dryer system 701 is shown, again having some or all of the features discussed above. System 701 is mounted to a wall 703, having a body 705 attached thereto and housing a drive unit 707, and further having a head unit 709 attached thereto.

Figure 8:
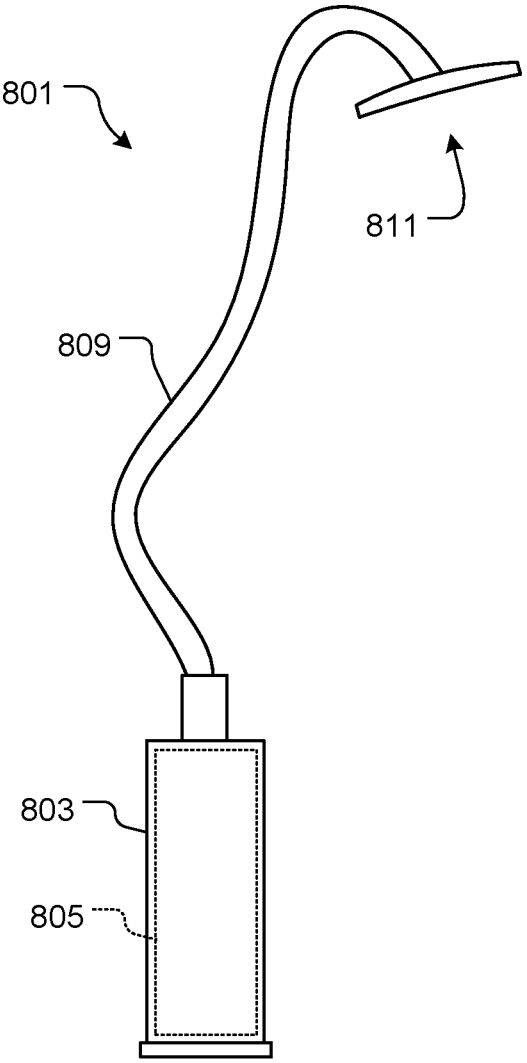
FIG. 8 is a side view of an alternative embodiment of a body dryer system in accordance with the present invention.

In FIG. 8, another alternative embodiment of a body dryer system 801 is shown, having a base 803 with a drive unit 805 and a flexible hose 809 extending to a head unit 811. Again, it should be appreciated that the features of the various embodiments can be interchanged.

It should be appreciated that another unique feature believed characteristic of the present invention is the drive unit 301. It should be appreciated that the drive unit is not limited to a body dryer, and could be used in a hand dryer, hair dryer, or any other apparatus in which it is desirable to create pressurized air in a compact space.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A body dryer system, comprising:

a drive unit configured to heat and pressurize air, the drive unit having:

an elongated housing forming an inner cavity and having:

a base configured to carry a plurality of batteries and configured to rest on a ground surface;

an opening extending through a wall thickness, the opening forming a scent pocket configured to removably contain a scent packet therein, the scent pocket is secured to the elongated housing;

an air inlet;

a turbo axial compressor carried within the inner cavity and having a turbo axial fan blade operated via a motor, the turbo axial compressor is in gaseous communication with the scent pocket;

a heating element in direct communication with the turbo axial compressor; and a converging chamber directly connected to the heating element;

a turbo axial compressor carried within the inner cavity and having a turbo axial fan blade operated via a motor;

a heating element in direct communication with the turbo axial compressor;

a converging chamber directly connected to the heating element;

an elongated tower extending from a first end to a second end;

a quick-disconnect secured to the converging chamber and the first end of the elongated tower, the quick-disconnect is configured to removably engage the elongated tower from the elongated housing;

a head unit configured to expel air toward the body of a user, the head unit in gaseous communication with the drive unit;

a swivel secured disposed between the head and the second end, the swivel is configured to allow rotational movement of the head relative to the second end; and a control system, the control system having:

a sensor secured to the head, the sensor is configured to sense a user proximate to the head;

wherein the plurality of batteries and the control system are configured to activate the drive unit; and wherein air is heated and pressurized via the drive unit and pushed through the head unit to be expelled.

2. The system of claim 1, wherein the sensor is a motion sensor.

3. The system of claim 1, further comprising:

a remote configured to wirelessly communicate with the control system.

4. The system of claim 1, wherein the control system further comprises:

one or more lights; and one or more speakers.

5. The system of claim 1, further comprising:

a flexible conduit extending from the drive unit to the head unit.

6. A method of drying, the method comprising:

providing the system of claim 1;

activating the drive unit via the control system, wherein air is pulled into the drive unit and pushed to the head unit;

adjusting the head unit as desired;

standing under the head unit to receive warmed and pressurized air; and allowing the warmed and pressurized air to evaporate water.

* * * * *